US005565845A

United States Patent [19]

Hara

[11] Patent Number: 5,565,845

[45] Date of Patent: Oct. 15, 1996

[54] WARNING GOLF BAG FOR MISSING CLUBS

[76] Inventor: Akira Hara, 501 Castle Kyoshin, 21-6, Himonya 2-chome, Meguro-ku, Tokyo, Japan

[21] Appl. No.: 477,763

[22] Filed: Jun. 7, 1995

[30] Foreign Application Priority Data

Jun. 10, 1994 [JP] Japan ..... 6-152893

[51] Int. Cl.[6] ..... G08B 13/14

[52] U.S. Cl. ..... 340/568; 340/686; 340/687; 340/527

[58] Field of Search ..... 340/568, 571, 340/572, 686, 687, 689, 527

[56] References Cited

U.S. PATENT DOCUMENTS

| | | | |
|---|---|---|---|
| 4,042,918 | 8/1977 | Klitzman | 340/568 |
| 4,489,314 | 12/1984 | Miller | 340/568 |
| 4,524,968 | 6/1985 | Dolp | 340/568 |
| 4,549,170 | 10/1985 | Serres et al. | 340/568 |
| 4,595,922 | 6/1986 | Cobb et al. | 340/568 |
| 4,661,806 | 4/1987 | Peters et al. | 340/568 |
| 4,791,411 | 12/1988 | Staar | 340/568 |
| 4,810,957 | 3/1989 | Rubbmark et al. | 340/568 |
| 4,819,015 | 4/1989 | Bullivant et al. | 340/568 |
| 4,859,993 | 8/1989 | Kagami et al. | 340/568 |
| 5,028,909 | 7/1991 | Miller | 340/568 |
| 5,041,815 | 8/1991 | Newton | 340/568 |
| 5,194,856 | 3/1993 | Zijlstra | 340/568 |

*Primary Examiner*—Jeffery Hofsass
*Assistant Examiner*—Benjamin C. Lee
*Attorney, Agent, or Firm*—Woodcock Washburn Kurtz Mackiewicz & Norris

[57] ABSTRACT

An apparatus monitors the number of golf clubs in a golf bag during a round of golf game and warns a golfer if any of the golf clubs is missing. According to one preferred embodiment, a predetermined number of golf clubs is automatically detected, and the total number of the clubs is stored in a memory for a later comparison. During a round, the number of clubs is detected and compared to the stored initial number so as to determine if any club is missing. Upon determining that a club is missing, a warning is given to the golfer. This warning substantially reduces a risk of losing a club.

22 Claims, 9 Drawing Sheets

WARNING GOLF BAG FOR MISSING CLUBS

FIELD OF THE INVENTION

The invention is generally related to methods and apparatus for warning a golfer of a missing club and more particularly related to methods and apparatus of detecting a missing club from a golf bag based upon a comparison between a predetermined number of golf clubs that is specified at the beginning of the round and a number of clubs present in the golf bag during the round so as to warn the golfer of the missing club for a faster retrieval.

BACKGROUND OF THE INVENTION

A golfer sometimes takes out from his golf bag more than one club when he is uncertain as to which club is the most suitable for his next shot and then forgets to retrieve unused club(s) after the shot. The player often does not notice the missing club(s) until a few holes later or even after the game. If a search for the misplaced club is delayed, the club may be retrieved later or his concentration in playing the game may be affected.

In order to reduce a risk of losing a golf club, prior attempts such Japanese Utility Model Application Laid-open No. Hei 2-61371 and Japanese Utility Model Application Laid-open No. Hei 2-61372 disclose warning devices. Hei 2-61371 discloses that a number of magnets are buried under and around a putting green or around a tee-ground. A magnet sensor is mounted on a golf cart to detect a signal indicating a club that is left behind as the golf cart passes over the buried the magnets. The magnet: sensor in turn sends a signal to a controller also mounted on the golf cart so as to activate an audio alarm or a tape unit for playing a warning message such as "attention, do not forget your club."

In a similar attempt, Hei 2-61372 discloses a golf cart that is equipped with a special putter holder that holds only putters. At the beginning of a round, a wight sensor placed at the bottom of the putter holder weighs putters, and the total weight is stored in a controller for a later comparison. Each time the golf cart stops and then moves during the course of a round, the weight sensor weighs the putters, and the controller compares the currently measured weight to the stored weight in the controller. If the controller determines that any putter is missing, it sends out a warning signal such as a voice message or an alarm sound.

The above described prior attempts disclose warning devices that are mounted on a golf cart. This type of arrangement is not particularly practical since golf carts are not usually transportable between courses, and on some courses, golf carts are not allowed. In fact, Hei 2-61371 further requires that magnets have be buries in the ground. The above described warning device, thus, should not require any modification to the course and should be easily portable. Furthermore, the warning device should be easily mountable on a commercially available standard golf bag without sacrificing a substantial storing capacity of the golf bag.

It is an object of this invention to provide an apparatus for a golf bag for monitoring the number of clubs in a golf bag while playing a round of golf in order to substantially reduce a risk of losing any club.

Another object of this invention is to provide an apparatus to detect a missing club and provide a warning at the earliest time after the club is left behind. One example of activating a check is when a putter is taken out and returned to a golf bag. Since a putter is almost certainly used on every hole, the use of the putter may trigger a check confirming the number of clubs before a player reaches the next tee ground. This timing minimizes an amount of time necessary for searching the misplaced club(s).

SUMMARY OF THE INVENTION

To accomplish the above described objectives and others, according to a first aspect of the current invention, a portable apparatus is provided to warn a golfer about any missing one of a predetermined number of golf clubs including a putter from a golf bag. The portable warning apparatus includes a memory disposed in the golf bag for storing information at least regarding the predetermined number of the golf clubs, the information defining initially stored information; a detector disposed in the golf bag for at least detecting the presence of the predetermined golf clubs in the golf bag so as to generate a club detecting signal; and a controller operationally connected to the detector for determining at least whether any of the predetermined golf clubs is missing from the golf bag based upon the club detecting signal and the initially stored information, upon determining a missing golf club, the controller generating a club missing signal; and a warning device in response to the club missing signal for waning the golfer about the missing golf club.

According to a second aspect of the current invention, a method is provided to warn a golfer about a missing club that is taken out from a golf bag and is not returned during a round of golf. The above method includes the following steps of: a) storing information regarding at least a number of predetermined clubs including a putter for use at the beginning of a round; b) detecting at least the presence of the predetermined golf clubs so as to generate a detection signal; c) comparing the detection signal obtained in the step b) to the information stored in the step a); d) determining whether any of the predetermined golf club is missing; and e) based upon a determination in the step d), warning a golfer.

According to a third aspect of the current invention, a portable system is provided to warn a golfer of any missing one of a predetermined number of golf clubs including a putter from a golf bag. The portable system includes a detector disposed in the golf bag for detecting at least the presence of each of the predetermined golf clubs in the golf bag so as to generate a club detecting signal; and a controller operationally connected to the detector for processing the club detecting signal. The controller further includes a memory housed for storing information at least regarding the predetermined number of the golf clubs, the information defining initially stored information; a process connected to the memory and the detector for comparing the detecting signal to the initially stored information so as to determine any of the predetermined clubs is missing from the golf bag, the processor generating a club missing signal; and a warning device in response to the club missing signal for warning the golfer about the missing golf club.

DETAILED DESCRIPTION OF THE PREFERRED EMBODIMENTS(S)

Figure 1:
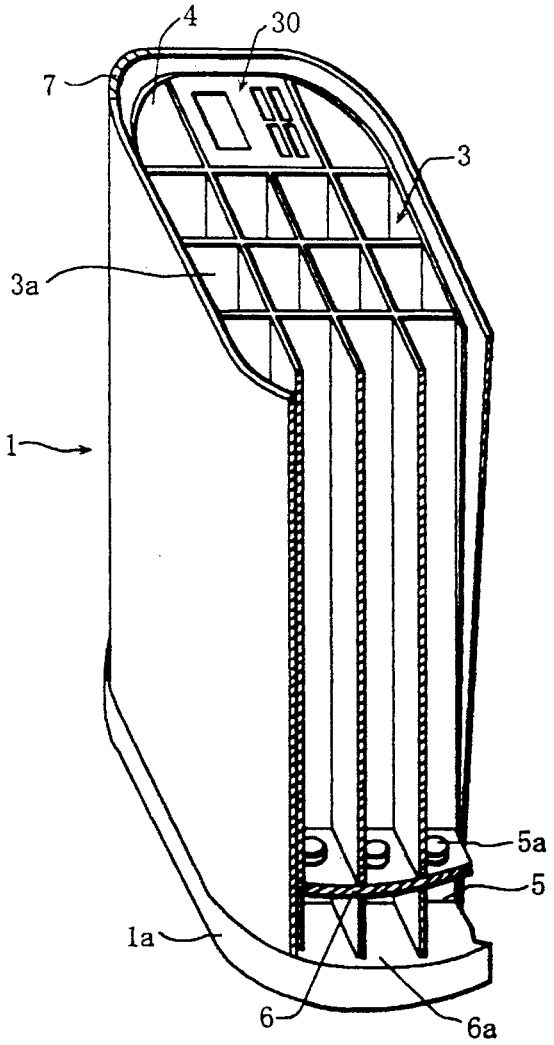
FIG. 1 is an external view depicting a partially exploded over all composition of a golf bag.
Figure 2:
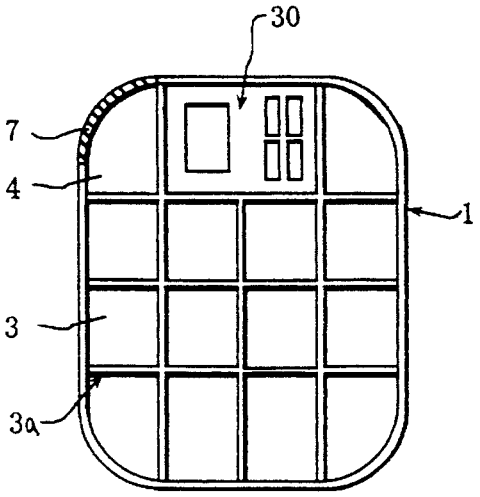
FIG. 2 is a top view of the golf bag.

The preferred embodiments according to the present invention will be explained in reference to the attached drawings. FIG. 1 is a partial cut away view of inside of a golf bag, and FIG. 2 is a top view of the golf bag. A club holding part 3 is placed inside of the golf bag 1 in order to individually hold a predetermined number of golf clubs 2, which include wood clubs such as a driver and a spoon, iron clubs such as a pitching-wedge and a nine iron as well as a putter. The club holding part 3 further includes club dividing walls a and a floor board 6. These two components form a predetermined number of individually separate compartments for each holding a club. According to one preferred embodiment, these compartments are arranged in a chess board configuration as shown in FIG. 2.

Figure 3A:
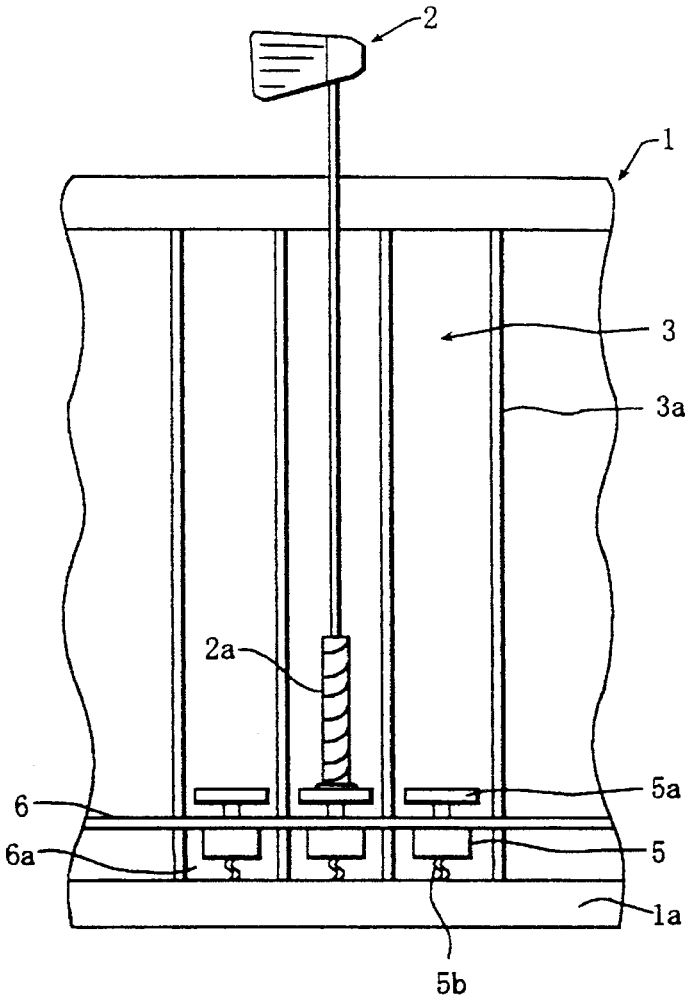
FIG. 3A is a cross-sectional view illustrating a first embodiment of the club detection means which responds to the weight of a club.

As shown in FIG. 3A, a club detecting sensor 5 (hereinafter referred to "sensor") includes a sensor body 5*b* which is placed under the floorboard 6 of the club holding part 3, and a sensor switch 5*a* which is projected from the floorboard into the club holding compartment. According to one preferred embodiment, the sensor 5 is placed at the bottom of every club holding compartment. When a club 2 is placed in one of the club holding parts 3, the bottom of a club grip 2*a* pushes the sensor switch 5*a* so that the switch is closed. The corresponding sensor 5 outputs a signal to a controller 30, which performs a predetermined process for monitoring the number of clubs. The controller 30 will be later described in more detail.

Figure 3B:
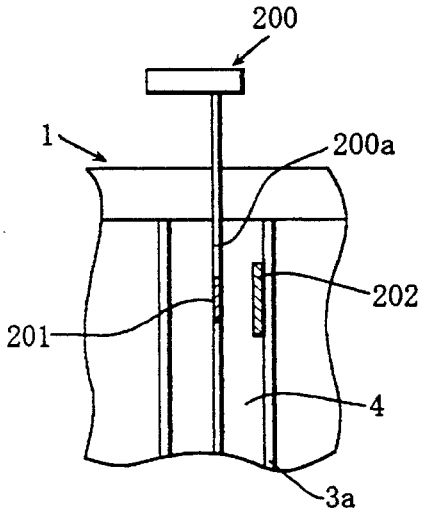
FIG. 3B is a cross-sectional view illustrating a second embodiment of the detection system.

In contrast to the above described a pressure sensitive switch, a non-contact switch may be also used. According to one preferred embodiment of the current invention, the non-contact switch is used in combination with the above described pressure sensitive sensors 5 so as detect only a predetermined club such as a putter. A marker 7 as shown in FIG. 2 signifies a putter holding position to hold a putter 200, and a golfer easily recognizes the marked holding position when he or she returns the putter to the golf bag. FIG. 3B shows a cross sectional view of the above preassigned putter holding part 4. The non-contacting switch 202 is placed on an inside wall of the preassigned putter holding part 4. To activate the non-contacting sensor 202, a magnetic band 201 is placed around a putter club shaft 200*a*. When such a putter is placed in the preassigned holding part 4 and the magnetic band 201 is in the vicinity of the non-contacting sensor 202, the sensor 202 is activated to generate a signal indicating the presence of the putter in the golf bag for the controller 30.

Figure 4A:
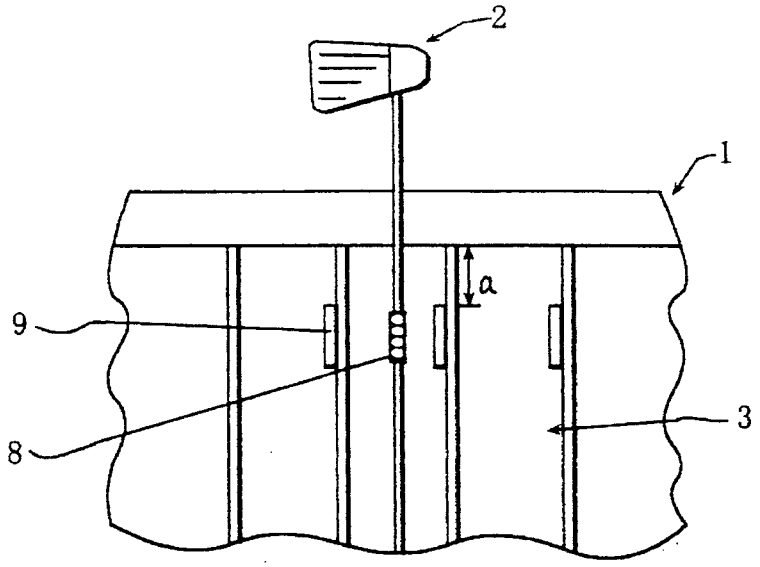
FIG. 4A is a cross-sectional view illustrating a third embodiment of the club detection system.
Figure 4B:
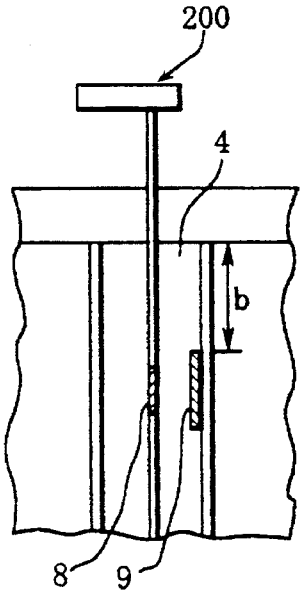
FIG. 4B is a cross-sectional view illustrating a fourth embodiment of the putter detection system.
Figure 4C:
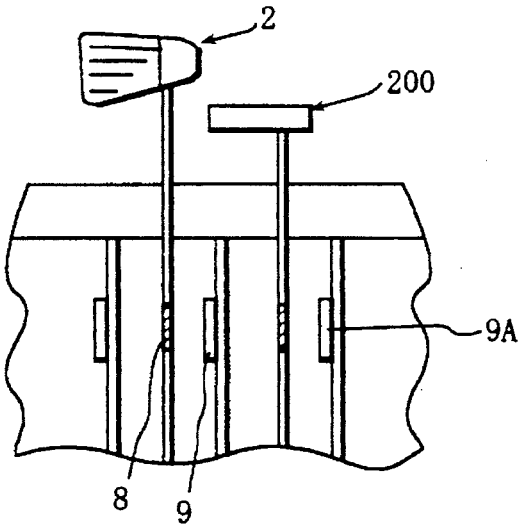
FIG. 4C is a cross-sectional view illustrating a fifth embodiment of the detection system.

Referring now to FIGS. 4A through 4C, an individual club is identified by modifying the following parameters. FIGS. 4A and 4B show that by varying the position of the magnetic band 8 and the corresponding position of the proximity switch 9 for each club, a unique detection is accomplished. For example, FIG. 4A illustrates the position of the magnetic band 8 and the proximity switch 9 at the predetermined distance a from the top of the golf bag for a particular iron club 2 while FIG. 4B illustrates the positions at another predetermined distance b from the top of the golf bag for a putter 200. Because of the particular predetermined distance, the sensor can detect the presence of a particular club that is returned to a preassigned holding part. FIG. 4C illustrates a combined use of various types of switches to detect a preassigned club. For example, the iron club 2 has a magnetic marker 8 to activate a proximity switch 9 located in a preassigned holding part while the putter 200 activates another type of detecting sensor 9*a* such as an electrostatic switch or light sensitive switch located in another preassigned holding part.

Figure 5:
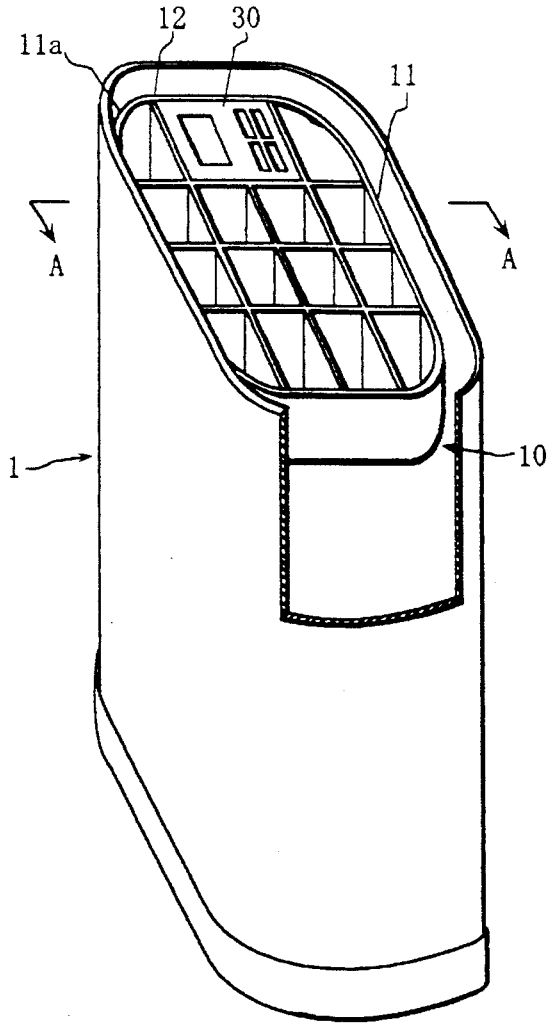
FIG. 5 is a perspective view with a partially removed portion of the golf bag containing a club dividing member for individually holding a predetermined number of golf clubs.

Referring to FIG. 5, the second preferred embodiment has an unique structure for a club dividing member so as to place the structure in a golf bag in a detachable manner. The club dividing member 10 is integrally formed with a club dividing part 11 in a chess-board pattern to be installed inside the golf bag opening. One of the club dividing parts may be exclusively assigned to a putter with a mark or an indication 12 located on a surface of putter dividing part 11a for indicating a putter holding position. The club dividing part 11 have incorporated sensors for detect clubs. The controller 30 is also disposed as an integral part of the club dividing part 11.

Figure 6:
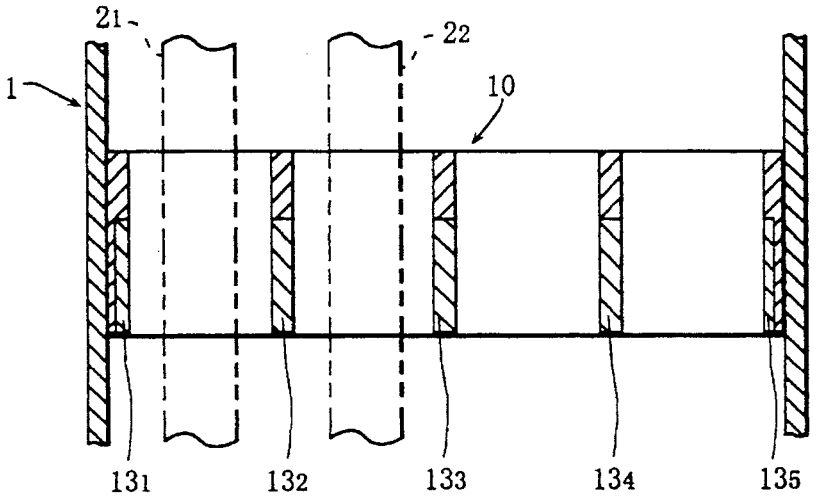
FIG. 6 is a cross-sectional view taking along a line A—A in FIG. 5.

FIG. 6 shows a cross sectional view of one example of the second preferred embodiment. To detect clubs, an electrostatic-capacity type sensors 13 are employed to detect a change in a dielectric constant caused by club shafts 21, 22. For example, when a club 21 is placed between electrodes $13_1$–$13_2$ that are located in respective walls forming the club dividing part 11, the above described change is detected and sent to a controller via lead wires. Since the dielectric constant depends upon a material of the club shaft, the electrostatic-capacity type sensor should be provided with variable sensitivity. Based upon the above difference in the constant, clubs may be uniquely identified. According to the above-described second preferred embodiment, an apparatus to monitor the number of clubs is installed in a commercially available ordinary golf bag by fitting the club dividing member 10 in an opening without sacrificing substantial storing capacity of the golf bag.

Figure 7:
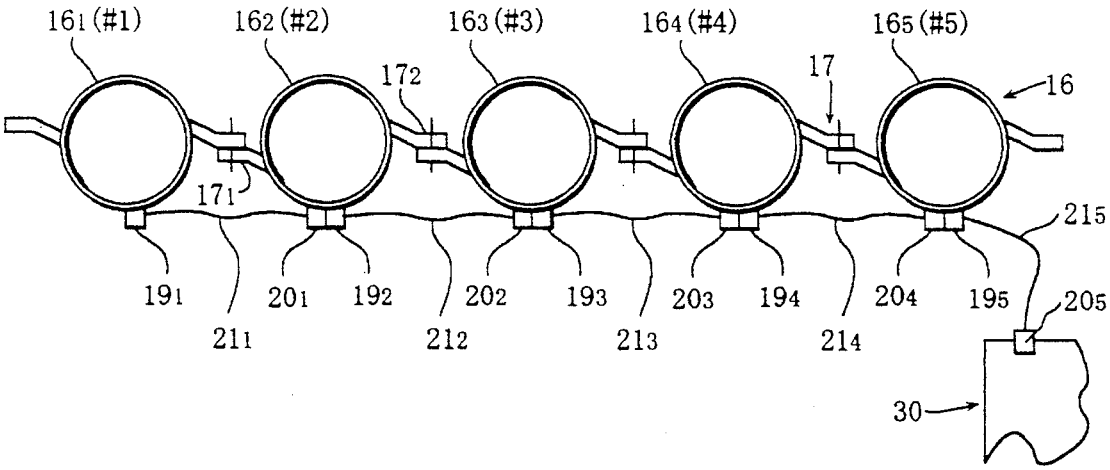
FIG. 7 is a top view for club holding tubes for holding the number of golf clubs.

FIG. 7 shows a top view of the third embodiment according to the current invention. In general, a plurality of club holding tubes 16 is connected by flexible connecting members 17 that are placed on an outer surface of each club holding tube 16. For example, five club holding tubes $\mathbf{16}_1$–$\mathbf{16}_5$ are held together by flexible connecting members 17 so as to place the five club holding tubes as a unit in the golf bag. One of the above-connected five club holding tubes may be in a different color from the rest and assigned to a putter for an easy reference. The connecting member 17 is composed of a pair of connecting members $\mathbf{17}_1$ and $\mathbf{17}_2$, which are respectively fixed at the adjoining club holding tubes. One connecting member $\mathbf{17}_1$ has a male connector, and other connecting member $\mathbf{17}_2$ has a female connector to connect adjoining connecting members. By connecting the several club holding tubes 16 via the connecting members 17, the club holding tubes are installed as a unit in the golf bag 1.

Figure 8:
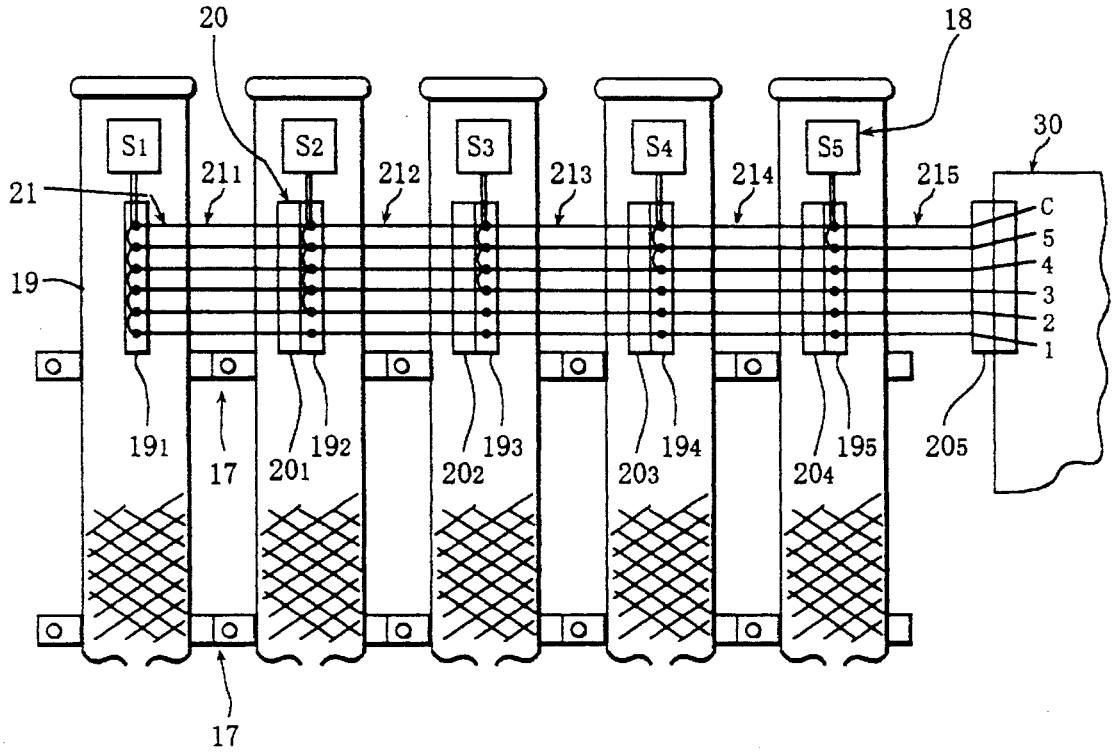
FIG. 8 is a side view of FIG. 7.

Referring to FIG. 8, club detecting sensors 18 ($S_1$–$S_5$) for detecting the clubs are placed on the club holding tubes $\mathbf{16}_1$–$\mathbf{16}_5$, and lead lines of the club detecting sensors 18 are connected in fixed connectors $\mathbf{19}_1$–$\mathbf{19}_5$ respectively placed on the outer surface of the club holding tubes 16. A plug connector 20 is arranged adjacent to the fixed connector 19 to connect to other fixed connectors 19 on the club holding tubes through a cable 21. Connecting points of the fixed connectors 19 support the lead lines of the sensors which are connected to the control panel 30. The number of connecting points is determined by the number of club holding tubes 16 that are connected by the connecting members. For example, if one club holding tube 16 is to be connected to a maximum of five other club holding tubes, the total number of connecting points are six. These six connecting points include the connecting point c for a common line connecting to each sensor and the five connecting points 1–5, each of which connects to lead lines of other sensors. The sensor cable 21 has at least a predetermined number of connecting points, or has channels of at least a predetermined number of sensors.

Figure 9:
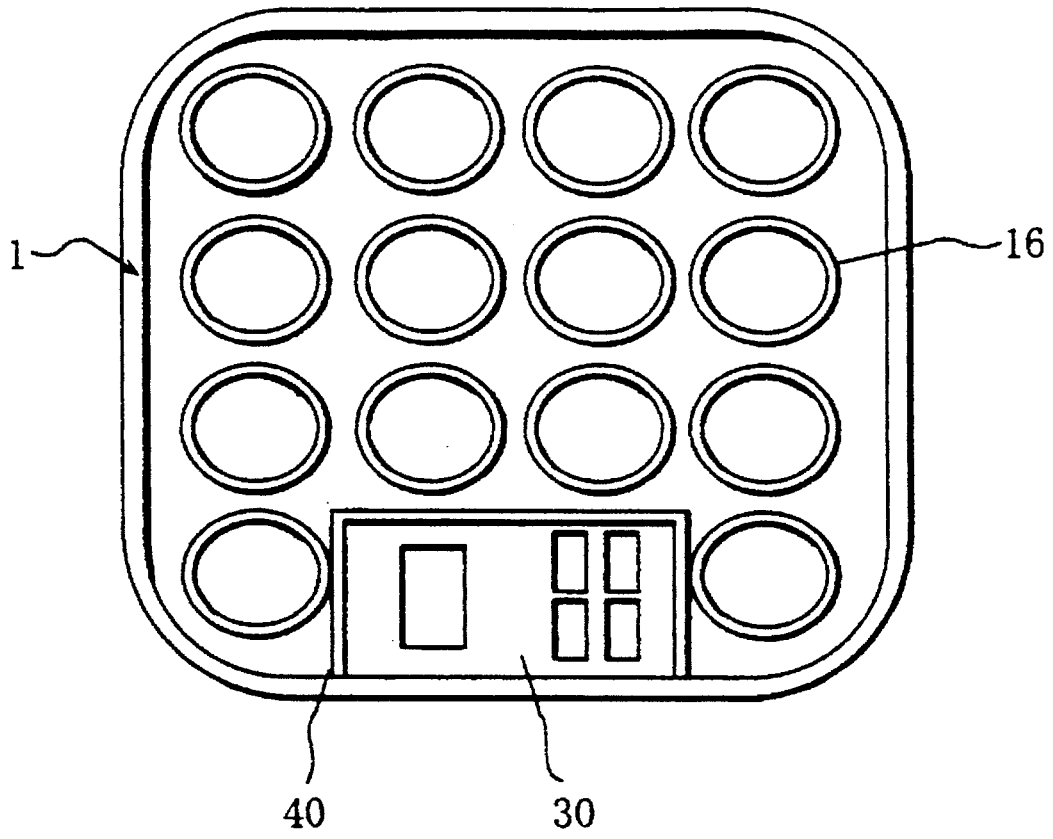
FIG. 9 is a top view depicting a golf bag which is provided with club holding members for holding the number of golf clubs by utilizing club holding tubes.

Still referring to FIG. 8, a number is preassigned to the club holding tubes 16 in order to avoid wrong connections when these tubes are put together. The connecting points of each sensor are also each assigned a number according to the tube number. For example, the sensor $S_1$ of the tube #1 has the connecting point 1, and the sensor $S_2$ of the tube #2 has the connecting point 2 and so on. By connecting the plug connector 20 to the fixed connector 19 of the next adjoining club holding tube and repeating the same procedures as further adjoining the tubes, electrical connections are completed. All of the signals outputted from the sensor 18 of the club holding tube are inputted to controller 30 by inserting the plug connector $\mathbf{20}_5$ of the last club holding tube into the controller 30. Now referring to FIG. 9, a top view illustrates that the above assembled club holding tubes 16 are placed in a golf bag opening along with a controller. The control panel 30 is fitted in a seat 40 provided on the upper golf bag.

Figure 10:
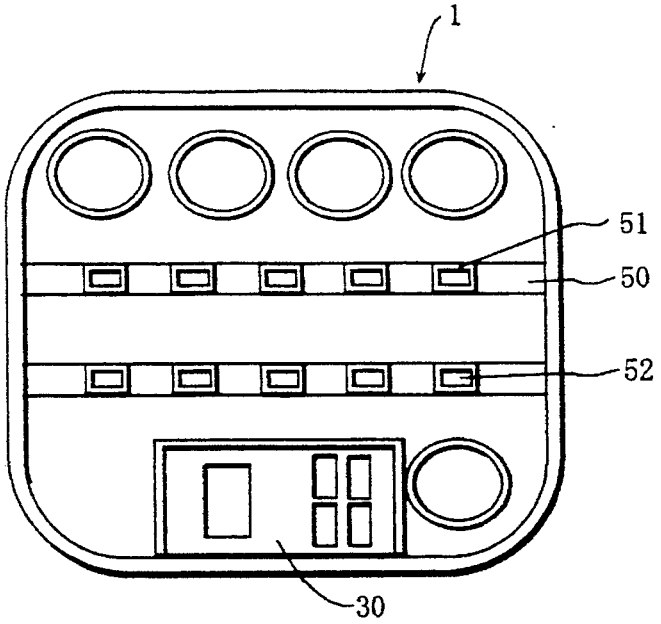
FIG. 10 is a top view depicting a golf bag with club holding racks for holding a number of golf clubs by their club heads.
Figure 11:
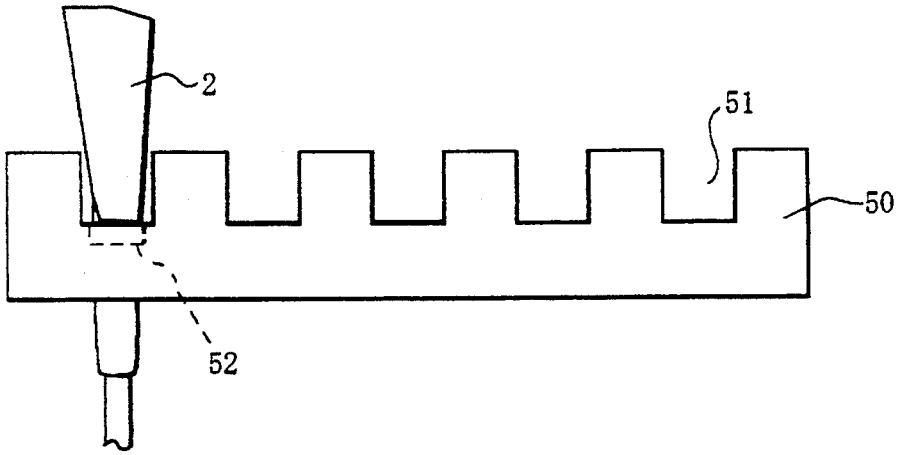
FIG. 11 is a sectional side view of the rack.
Figure 12:
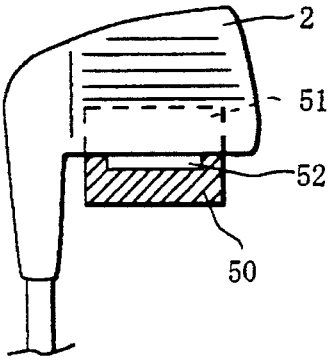
FIG. 12 is a cross-sectional view of the rack for holding a part of a club head.

FIG. 10 shows the fourth embodiment according to the current invention, wherein a rack 50 to hold club-heads of the golf clubs also detects the presence of clubs. The rack 50 is assembled in a commercially available golf bag in a detachable manner or in a permanent manner. The rack 50 includes head rests 51 to hold the club-heads, and the head rests 51 are formed on concave surfaces of the rack in accordance with the holding positions of the clubs as shown in FIG. 11. Each head rests 51 also includes a sensor to detect the club heads. For example, a contact type sensor such as a weight sensor 52 may be placed at the bottom of each concave forming surface of the head rest to detect the club by its weight when the club-head is engaged in the concave surface as shown in FIG. 12. In another example, a non-contact type sensor such as a light sensitive sensor or a proximity sensor is placed on the opposite walls of the concave part to detect the club-head for detecting a club.

Figure 13:
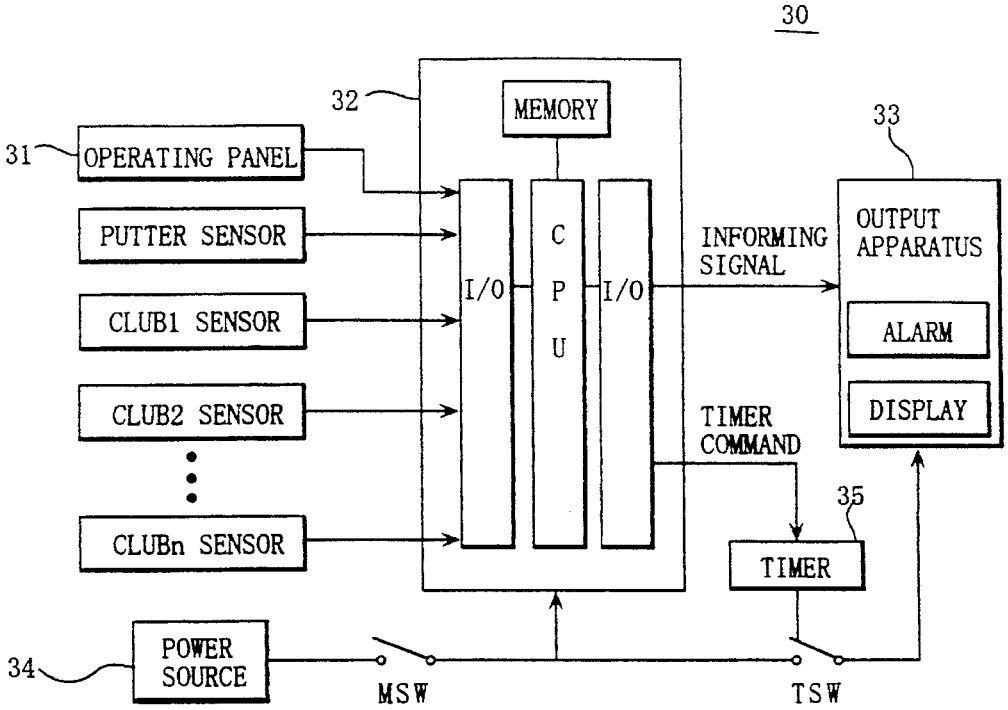
FIG. 13 is a control block diagram of the apparatus for storing, ascertaining and confirming the number of golf clubs according to this invention.

FIG. 13 shows a block diagram of the controller 30 According to one preferred embodiment of the current invention, the controller 30 generally includes a power source 34, an operating panel 31, an output device 33 and a processor 32, and the controller 30 is selectively disposed at an upper portion of the golf bag. In the alternative embodiments, the controller 30 may be placed at the bottom of the golf bag or in both at the top and the bottom of the golf bag. However, the controller 30 does not have to be placed at a particular position in order to practice the current invention.

Still referring to FIG. 13, the processor portion 32 is designed for interfacing among an input and output (I/O) devices, a memory and a CPU, which are connected to a power source 34 through the main-switch (MSW). The memory contains a program containing data necessary for ascertaining the number of clubs in a manner described below in detail. The input interface is designed to input information regarding clubs in use, the input signals from the operating panel and input signals from the club detecting sensors, and the output signals including a signal to the output apparatus and a timer control command to the timer 35. The timer 35 switches on and off a timer SW (TSW) of a power source line as necessary in order to save the power to the output apparatus 33.

According to one preferred embodiment, at the beginning of a round, the processor 32 initially activates the sensors and the sensors each send a signal indicating the existence of the club. Upon receiving the signals, the processor 32 stores the number of the total existing clubs in memory for a later comparison. In an alternative embodiment, at the beginning of a round, a golfer manually sets the total number of clubs that he uses for the day via an operating panel 31. In general, during the round, when a predetermined club such as a putter is taken out, a putter sensor generates a signal indicating that the putter is out of a golf bag, and in response to the generated signal, a CPU activates a timer 35. When the timer 35 indicates the end of a predetermined time period and the putter has not been returned to the golf bag, the CPU activates an output apparatus 35 such an alarm and or a display for warning a golfer.

Figure 14:
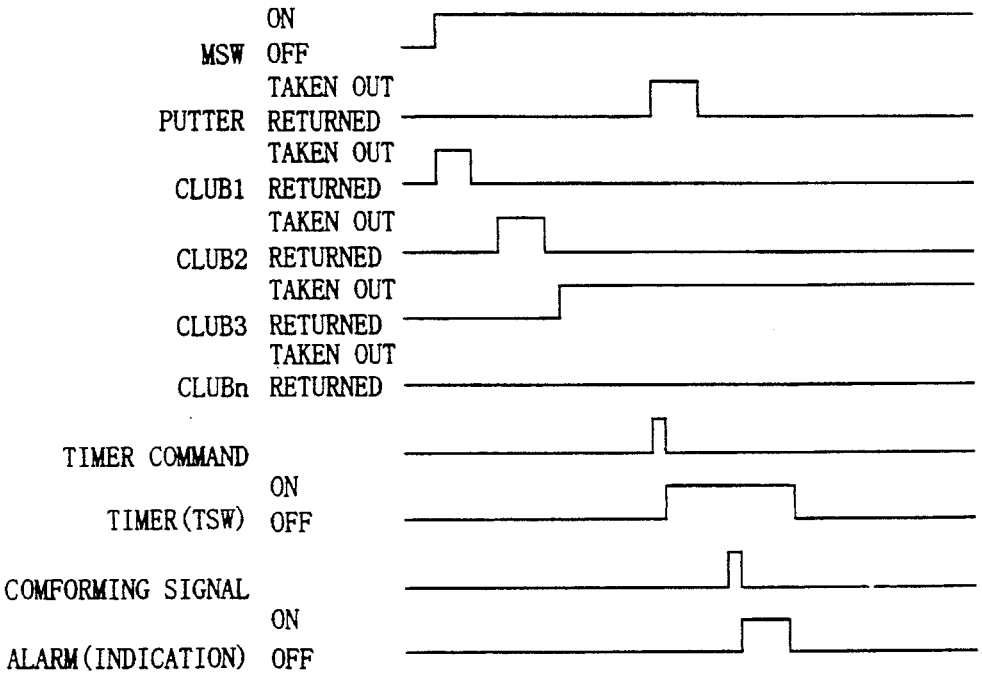
FIG. 14 is a timing diagram-chart showing an operating state of the apparatus for ascertaining and confirming the number of golf clubs.

FIG. 14 is an example of a timing diagram for the operation of the above described system. When MSW is switched ON and the club holding part holds all the clubs to be used for playing a round of golf, the initial club detecting process is performed to determine a total number of clubs present in a golf bag. This total number of clubs is stored in a memory for a later comparison. During the course of playing, when any club is taken out of the golf bag, the state of a corresponding sensor changes to ON, and the sensor signal is inputted into a processor. When a putter is taken out of the golf bag, the corresponding putter sensor generates a ON signal and a timer is activated. Later, if the putter is returned, the putter sensor generates an OFF signal. On the other hand, when one of the clubs 1 through N other than the putter is taken out, the timer is not activated. The club checking process starts in response to the above described putter OFF signal and determines if every club other than a putter is present in the golf bag. According to FIG. 14, when the putter is taken out and returned, the club checking process finds that CLUB 3 has not been yet returned. The checking process generates a conforming signal for the missing club. The output apparatus in response to the conforming signal activate an alarm and informs the player of the missing club. The alarm includes an audio alarm, a visual display and a combination of both. In response to the warning display or alarm, the golfer ascertains the number of clubs and takes corrective measures to recover the misplaced club(s).

Figure 15:
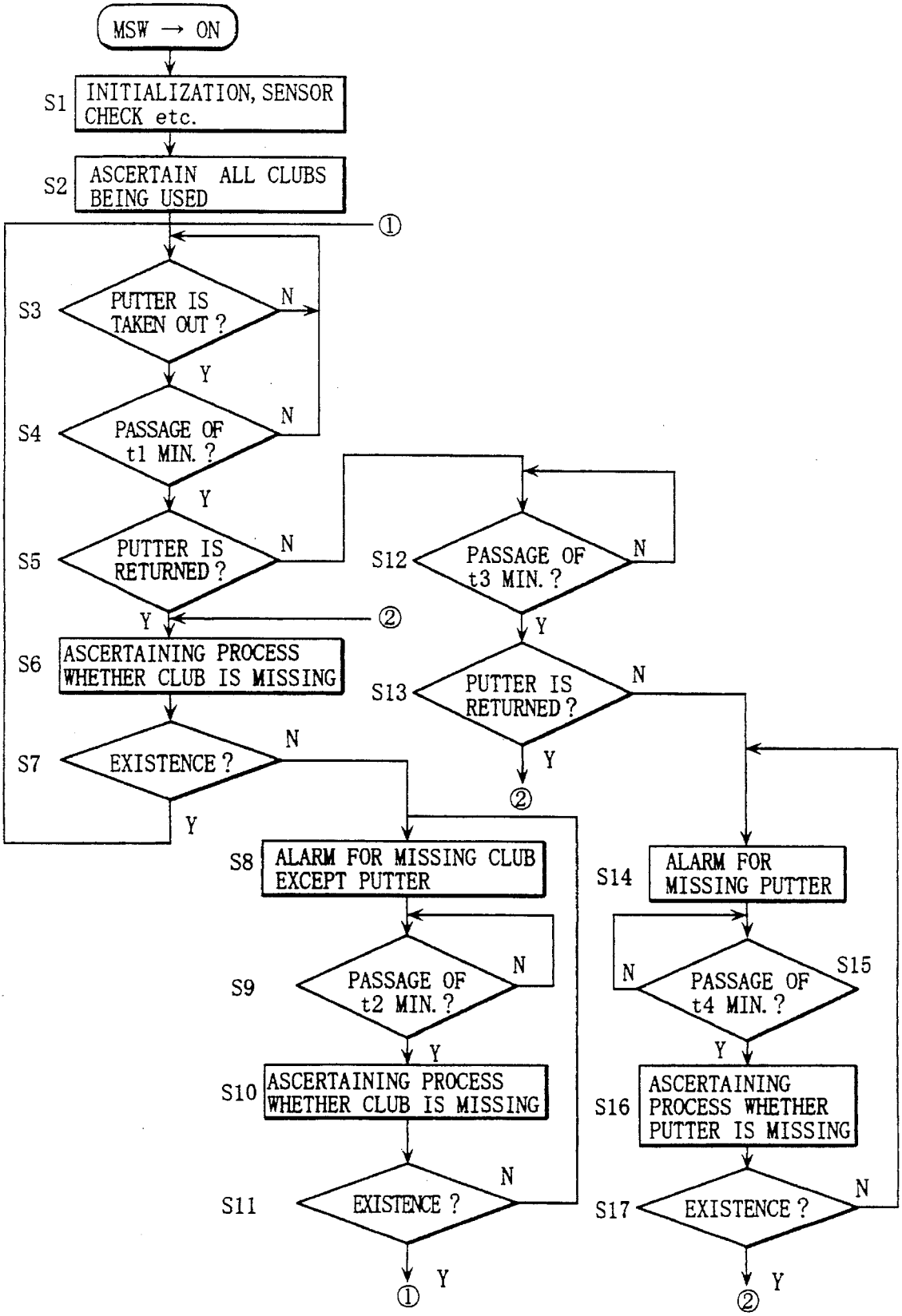
FIG. 15 is a flow-chart depicting a control system according to the current invention.

According to one preferred embodiment, the operation of the system will be described in accordance with a flowchart in FIG. 15. In Step 1, CPU including the memory as well as sensors are initialized when MSW is switched ON. Also in Step 1, the output apparatus and the timer are initialized to assure the normal operating condition of the system. In Step 2, a club checking program performs an initial determination of the clubs to be used for a round of golf. As described above, information obtained after this initial determination is stored in memory for later use. If a putter is taken out from the golf bag in Step 3, a timer is activated. After a predetermined time t1 minute(s) has elapsed in Step 4, if is determined that the putter has not been returned in Step 5, a timer is activated again. On the other hand, if the putter is put back in the golf before the t1 minutes has elapsed, Step 3 is repeated. If the putter is returned after the t1 minutes, the club checking process is performed as to whether any other clubs are missing in Step 6. If it is determined that all the clubs are present in the golf bag, the flow goes back to the Step 3.

If it is determined that a club is misplaced in Step 7, the alarm for the missing club other than the putter is activated in Step 8 in order to catch attention of the golfer. The passage of t2 minutes is determined in Step 9 while the golfer takes measures to retrieve the misplaced clubs. After the passage of t2 minutes, the club checking process is performed again in Step 10. If it is determined that the lost club is returned to the golf bag in Step t1, the flow goes back to Step 3. On the other hand if the lost club is not returned after the t2 minutes in Step 11, the flow goes back to the step 8 to activate the alarm again.

In Step 5, if the putter is not returned to the club holding part, after the passage of t3 minutes in Step 12, the putter checking process is performed again to determine as to whether the putter is returned in Step 13. When the putter is present in the preassigned position, the flow advances to the step 6 to perform the club checking process. If the putter is not returned in a preassigned position, the alarm for the missing putter is activated in Step 14. After the passage of t4 minutes, the putter checking process is performed in Step 16. If the lost putter is returned in the right holding position, the flow advances to Step 6. On the other hand, when the misplaced putter is not returned, the flow goes back to Step 14 in order to activate the alarm for the missing putter again.

The above-described embodiment has illustrated that MSW is turned ON and CPU runs while all the clubs are in use and held in the club holding part. However, the CPU can be initialized by pushing the reset button by just before using the system to perform the club checking process. In addition, the above described embodiment differentiates a putter from other clubs and uses the use of the putter as a trigger for performing a putter checking process as well as a club checking process.

According to the above-illustrated embodiments, since the system is provided in the golf bag, the club ascertaining process can be automatically carried out when the golfer takes out and puts back a putter at every hole in the game. Consequently, the player's misplaced club(s) can be detected early and a loss of club(s) are substantially prevented.

In alternative embodiments, the above differentiation between a putter and other clubs is not used. As described above, at the beginning of a round, a set of particular clubs to be used for the day is inputted either manually or automatically. In an automatic mode, the set of clubs to be used is first placed in a golf club, and the system is activated so as to automatically determine the number of clubs. In a manual mode, a player specifies a set of clubs to be used by inputting via an operating panel of the system. In addition to the club information, a golfer optionally selects a number of particular clubs that activate a checking process as well as a timer, the duration of the timer and a choice of a warning device. For example, the player selects a driver and a putter so that every time either of these selected clubs is used and a user specified amount of time such as seven minutes has elapsed, a controller performs a club checking process to determine whether any club is missing. If any club is determined to be missing based upon the initially stored information, the controller activates the user selected warning device such as a visual display. These user selected information is stored in memory for later use.

Furthermore, other alternative embodiments according to the current invention include non-contacting sensors that not only detects the presence of a club but also identify a particular club. For example, a non-contacting sensor such as a laser scanner reads a marker such a bar code placed on the club. Such markers also include an optical marker and any other means that encodes a particular information unique to each club. In such alternative embodiments, clubs need not be assigned to particular holding parts. Since the non-contacting sensors can read the unique information from the marker to identify each club, a warning message is precise as to which club is missing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed:

1. A portable apparatus for warning a golfer about any missing one of a predetermined number of golf clubs including a putter from a golf bag, comprising:

a memory disposed in the golf bag for storing information at least regarding the predetermined number of the golf clubs, said information defining initially stored information;

a detector disposed in the golf bag for detecting at least the presence of one of the predetermined golf clubs in the golf bag so as to generate a club detecting signal; and a controller operationally connected to said detector for determining at least whether any of the predetermined golf clubs is missing from the golf bag based upon said club detecting signal and said initially stored information, upon determining a missing golf club, said controller generating a club missing signal; and a warning device in response to said club missing signal for warning the golfer about said missing golf club.

2. The apparatus for warning a golfer according to claim 1 wherein said detector is a contact switch.

3. The apparatus for warning a golfer according to claim 1 wherein said warning device is a light display.

4. The apparatus for warning a golfer according to claim 1 wherein said warning device is an audio alarm.

5. The apparatus for warning a golfer according to claim 1 wherein said controller further comprises an input device for the golfer to input said initially stored information.

6. The apparatus for warning a golfer according to claim 1 wherein said detector is a non-contact switch.

7. The apparatus for warning a golfer according to claim 6 wherein said non-contact switch reads a uniquely identifiable label placed on each of the predetermined golf clubs.

8. The apparatus for warning a golfer according to claim 1 wherein said controller further comprises a timer for providing a time limit for the golfer to return said missing golf club to the golf bag, said timer generating a time limit signal at the end of said time limit.

9. The apparatus for warning a golfer according to claim 8 wherein said controller further determines as to whether said missing golf club is returned to the golf bag in response to said time limit signal.

10. The apparatus for warning a golfer according to claim 9 wherein said initially stored information includes information regarding the predetermined golf clubs and said warning device.

11. A portable system for warning a golfer of any missing one of a predetermined number of golf clubs including a putter from a golf bag, comprising:

a detector disposed in the golf bag for detecting at least the presence of each of the predetermined golf clubs in the golf bag so as to generate a club detecting signal; and a controller operationally connected to said detector for processing said club detecting signal, said controller further comprising:

a memory housed for storing information at least regarding the predetermined number of the golf clubs, said information defining initially stored information;

a processor connected to said memory and said detector for comparing said detecting signal to said initially stored information so as to determine any of the predetermined clubs is missing from the golf bag, said processor generating a club missing signal; and a warning device in response to said club missing signal for warning the golfer about said missing golf club.

12. A portable system for warning a golfer of any missing club according to claim 11 wherein said controller having a housing, said memory, said warning device and said processor being housed in said controller housing.

13. A portable system for warning a golfer of any missing club according to claim 12 wherein said detector and said controller are portable and fit in the golf bag without sacrificing a substantial storing capacity of the golf club.

14. A method of warning a golfer about a missing club that is taken out from a golf bag and is not returned during a round of golf, comprising the following steps of:

a) storing information regarding at least a number of predetermined clubs including a putter for use at the beginning of a round;

b) detecting at least the presence of the predetermined golf clubs so as to generate a detection signal;

c) comparing said detection signal obtained in said step b) to said information stored in said step a);

d) determining whether any of the predetermined golf club is missing; and e) based upon a determination in said step d), warning a golfer.

15. The method of warning a golfer about a missing club as recited in claim 14 wherein said step b) is performed by physically contacting the predetermined golf clubs.

16. The method of warning a golfer about a missing club as recited in claim 14 wherein said step b) is performed without physically contacting the predetermined golf clubs.

17. The method of warning a golfer about a missing club as recited in claim 14 wherein said step b) identifies each of the predetermined golf clubs.

18. The method of warning a golfer about a missing club as recited in claim 14 wherein said step e) warns the golfer by a visual display.

19. The method of warning a golfer about a missing club as recited in claim 14 wherein said step e) warns the golfer by a audio alarm.

20. The method of warning a golfer about a missing club as recited in claim 14 wherein said steps b) through e) are repeated on a periodic basis if a missing club is not returned to the golf bag within a predetermined time limit.

21. The method of warning a golfer about a missing club as recited in claim 14 wherein said information includes at least a mode of warning and the predetermined number of the golf clubs.

22. The method of warning a golfer about a missing club as recited in claim 21 wherein said information is selected by the golfer.

* * * * *